US006262651B1

(12) United States Patent
Miyamoto et al.

(10) Patent No.: US 6,262,651 B1
(45) Date of Patent: Jul. 17, 2001

(54) COIL DEVICE

(75) Inventors: Masami Miyamoto; Yoshiyuki Suzuki; Yoshihiro Mochizuki; Tetsuya Suzuki, all of Minato-ku (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 09/409,283

(22) Filed: Sep. 30, 1999

(30) Foreign Application Priority Data

Jan. 7, 1999 (JP) ..... 11-002158

(51) Int. Cl.[7] ..... H01F 27/02; H01F 27/29

(52) U.S. Cl. ..... 336/192; 336/229; 336/198; 336/90

(58) Field of Search ..... 336/192, 198, 336/82, 90, 229; 439/716

(56) References Cited

FOREIGN PATENT DOCUMENTS

020298005 * 10/1990 (JP) .
406231963 * 8/1994 (JP) ..... 336/192
0122608 * 11/1998 (JP) ..... 336/192

* cited by examiner

*Primary Examiner*—Michael L. Gellner
*Assistant Examiner*—Anh Mai
(74) *Attorney, Agent, or Firm*—Wenderoth, Lind & Ponack, L.L.P.

(57) ABSTRACT

A coil device includes a coil body with a wiring coil wound therearound. The coil body is composed of an insulative core cover with a core received therein. An insulative base is provided with terminals, which the coil body is to be mounted thereon. The core cover includes a planar support portion to be attached to the base, and one of the support portion and the base has, at areas in the vicinity of opposite end portions thereof, engagement grooves, and the other has, at areas in the vicinity of opposite ends thereof, ridges engageable with the engagement grooves. Thus, the support portion can be engaged with the base through a combination of the engagement grooves and the ridges.

6 Claims, 2 Drawing Sheets

COIL DEVICE

BACKGROUND OF THE INVENTION

This invention relates to a coil device utilized for various types of electronic apparatuses such as a display unit, power supply equipment and the like.

FIG. 3 is an illustration showing an example of known process steps for assembling a known toroidal type coil device. The coil device generally denoted by reference numeral 20 comprises a coil body with a wiring coil wound therearound, which coil body is composed of a synthetic resin core cover 30 with a core 22 received therein, and a synthetic resin base 24 which is provided with terminals 25 and on which the coil body is to be mounted.

The coil device 20 is assembled in the following sequential steps, for example.

First, toroidal magentic core 22 is received between case halves 21, 21 and integrally assembled into a unitary structure with the core cover 30. The core cover 30 thus obtained is then placed on the base 24 and a claw-like portion 23 formed on its bottom portion is brought into engagement with an edge portion of an engagement hole 26 formed in a central portion of the base 24. At that time, in order to eliminate attachment chattering (looseness of joints) of the core cover 30, the core cover 30 and the base 24 are attached together by adhesive agent or the like after the claw-like portion 23 is engaged with the engagement hole 26. After the core cover 30 and the base 24 are firmly attached together, a terminal portion of the wiring coil is soldered to a pin terminal 25 projecting from the base 24. By doing so, the procedure for assembling the coil device 20 is completed. The winding operation of the wiring coil 27 is performed after the core cover 30 is assembled or after the core cover 30 is firmly attached to the base 24.

However, the engagement mechanism between the core cover 30 and the base 24 has such a shortcoming that the engagement portion (namely, the claw structure) is inevitably reduced in size compared with the core cover 30 in view of structure, with the result that the assembled coil device 20 is inferior in vibration resistance and shock resistance. For this reason, it is difficult to apply the above engagement mechanism to a larger-sized core without sacrificing reliability. If adhesive agent or the like is used in order to enhance vibration resistance and shock resistance, the assembling process steps and material expenses are increased, thus resulting in higher manufacturing cost.

SUMMARY OF THE INVENTION

It is, therefore, an object of the present invention to provide a coil device by which it is possible to obviate the shortcoming inherent in the prior art device, and which provides an economical efficiency and excellent vibration resistance and shock resistance.

In order to achieve the above object, there is essentially provided a coil device comprising:

a coil body having a magnetic core, a wiring coil wound around said magnetic core, and an insulative core cover for receiving therein said magnetic core, and an insulative base, having terminals, for mounting thereon said coil body, wherein said core cover has a planar support portion adaptable to said insulative base, one of said support portion and said insulative base having, at areas in the vicinity of opposite end portions thereof, engagement grooves, and the other of said support portion and said insulative base having, at areas in the vicinity of opposite ends thereof, ridges engageable with said engagement grooves, so that said support portion may be brought into engagement with said insulative base through an engagement mechanism composed of said engagement grooves and said ridges.

By virtue of the above construction, the core cover can firmly be attached to the base because the former is engaged with the latter at two spots (i.e., opposite ends) of the support portion due to the engagement structure between the engagement groove and the ridge. Thus, the coil device is enhanced in vibration resistance and shock resistance. This makes it possible to apply the present invention to a larger-sized core without sacrificing reliability.

The engagement mechanism is preferably provided with a stopper.

By virtue of a provision of a stopper, the core cover, when being attached, can easily and reliably be positioned. Thus, the coil device can more easily be assembled.

It is preferred that either the support portion or the base is provided with a claw-like portion and the other is provided with an interlocking protrusion which can be interlocked to the claw-like portion.

By virtue of the above construction, the core cover, when once attached, is not easily detached from the base due to the interlocking mechanism. Thus, the coil device has further enhanced vibration resistance and shock resistance.

It is an interesting alternative that either the support portion or the base is provided with a projection and the other is provided with a recess engageable with the projection.

Owing to the above further engagement mechanism composed of a projection and a recess, the core cover has enhanced accuracy of attachment position. This makes it possible to eliminate the attachment chattering (or loseness of joints) of the coil device.

DETAILED DESCRIPTION OF THE PREFERRED EMBODIMENT

A coil device according to one preferred embodiment of the present invention will now be described with reference to FIG. 1 which shows process steps for assembling a toroidal type coil device such as, for example, a choke coil device incorporated with the present invention, and FIG. 2 which is a bottom view of a core cover of the coil device of FIG. 1.

Figures 1, 2:
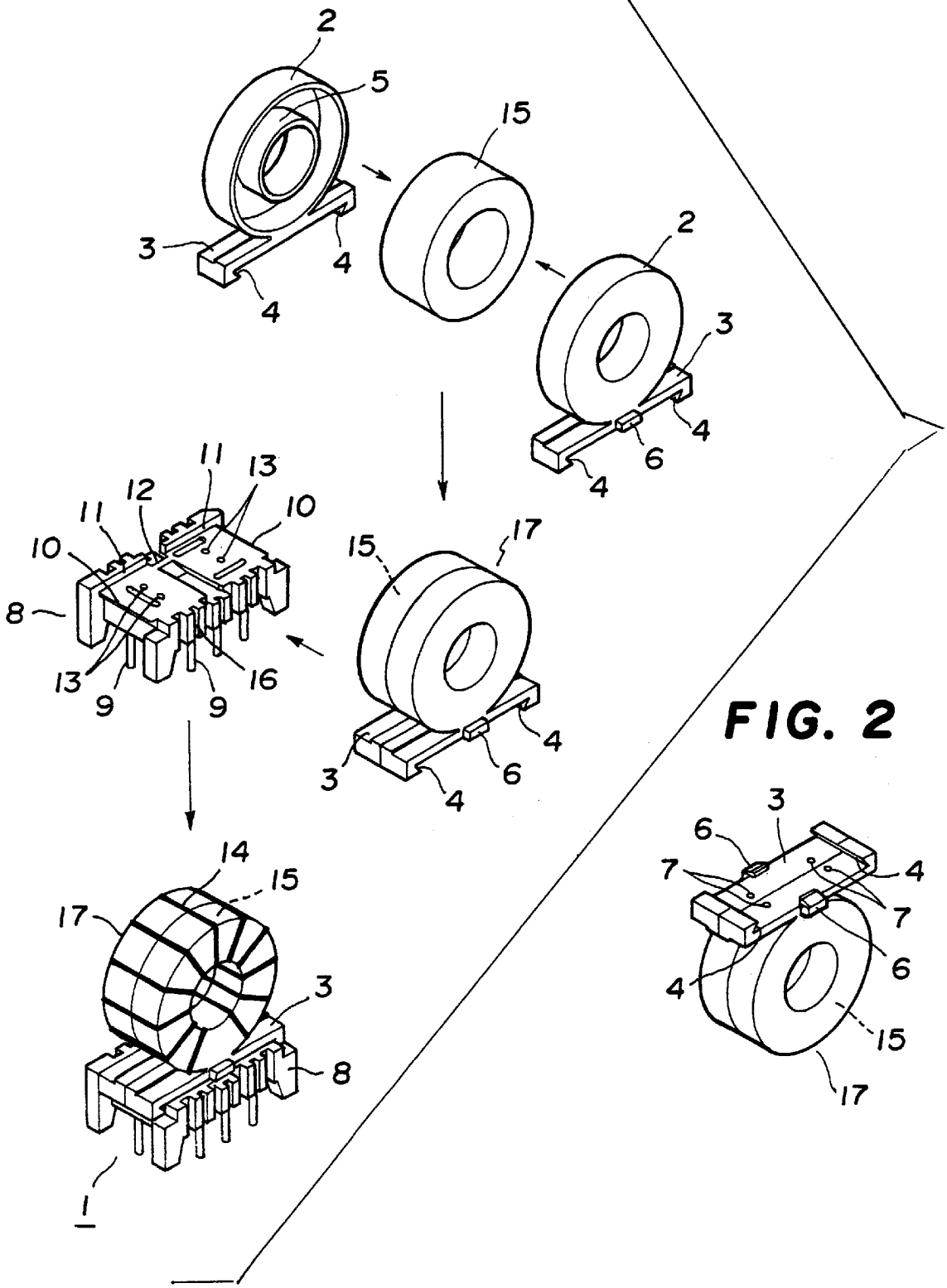
FIG. 1 is a diagrammatic, perspective view showing the process for assembling a toroidal type coil device incorporated with the present invention.
FIG. 2 is a bottom view of a core cover of the coil device shown in FIG. 1.
Figure 3:
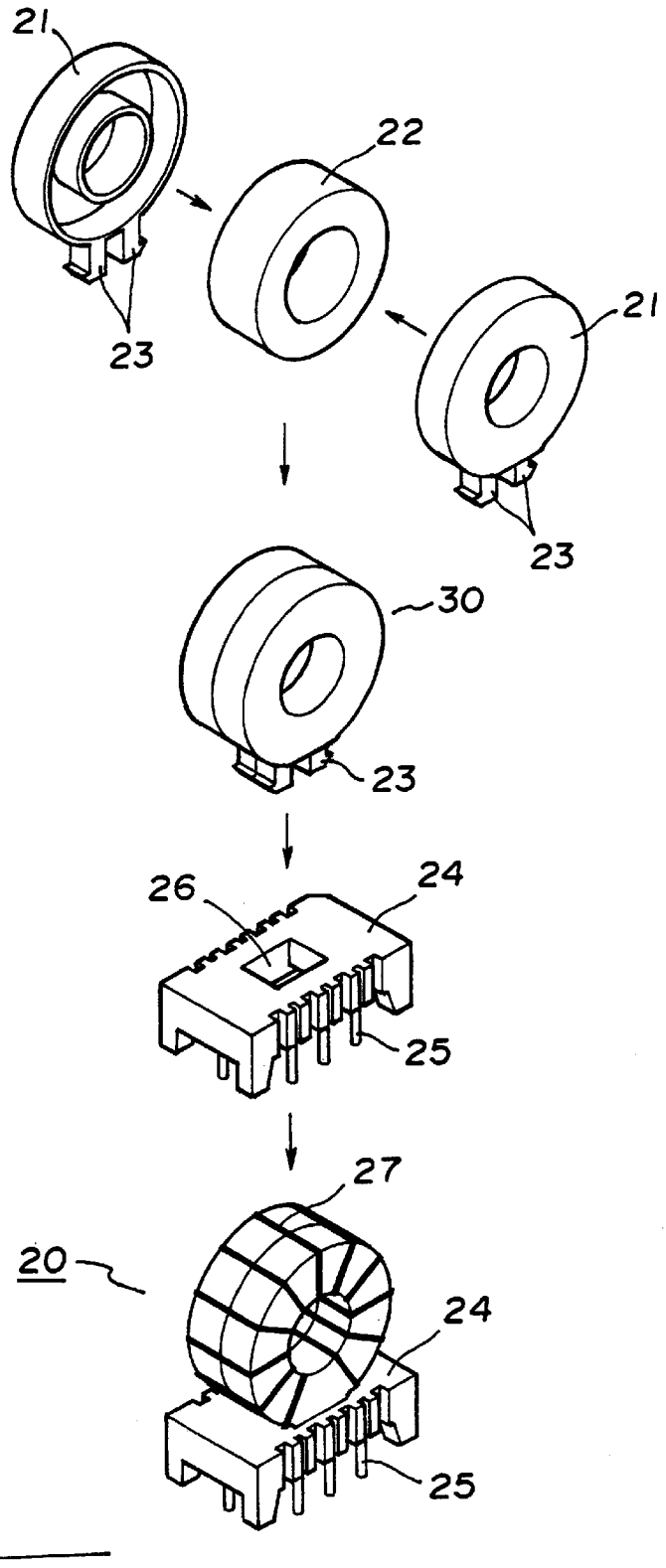
FIG. 3 (PRIOR ART)
FIG. 3 is a diagram showing known process steps for assembling a conventional toroidal type coil device.

As shown in FIG. 1, a coil device 1 according to the present invention comprises a toroidal type magnetic core 15, a synthetic resin core cover 17 for receiving therein the core 15, and a synthetic resin rectangular base 8 on which the core cover 17 is to be mounted. The core cover 17 is provided with a wiring coil 14 wound therearound, thus forming a coil body. The coil body is mounted on the base 8 which serves as a terminal base for the coil body.

The coil cover 17 is composed of two sleeve-like case halves 2 each having a flattened rectangular support portion 3 on basal portions thereof. Each of the case halves 2 is provided with a sleeve-like partition wall 5 projecting from a central area of its interior, thus defining a donut-like or annular space for receiving the toroidal type core 15.

The base 8 is provided on a bottom side (i.e., reversed side) thereof with a plurality of pin terminals 9 to be connected with external counterparts. The base 8 is also provided on side portions thereof with guide grooves 16 for the wiring coil 14 in such a manner that the guide grooves 16 correspond to the pin terminals 9.

The support portion 3 for the core cover 17 is provided with V-shaped engagement grooves 4 which are formed, in parallel relation, in longitudinal opposite ends of a reserve surface of the support portion 3. The base 8 is provided with V-shaped ridges 10 which are formed, in a rail-like pattern, on longitudinal opposite ends thereof in such a manner as to correspond to the engagement grooves 4, so that the ridges 10 can be inserted into the corresponding engagement grooves 4. The engagement grooves 4 and the ridges 10 constitute an engagement mechanism between the core cover 17 and the base 8.

With the above-mentioned construction, the core cover 17 is fixedly engaged with the base 8 because the former is engageable with the latter at two spots (i.e., longitudinal opposite ends) thereof due to engagement between the engagement grooves 4 and the ridges 10. Thus, the assembled coil device 1 has satisfactory vibration resistance and shock resistance. This engagement structure would make it possible to provide a sufficient reliability of vibration resistance and shock resistance even if the core size should be changed. This means that the inventive structure can be applied to a larger-sized core without sacrificing reliability.

The base 8 is provided with stoppers 11. The stoppers 11 are formed by protruding one side edge of the base 8 and are adapted to prevent further movement of the core cover 17 in a lateral sliding direction. By virtue of this stopper mechanism, the core cover 17 can be positioned easily and reliably because the side surface of the support portion 3 is brought into abutment with the stoppers 11 in a desired sliding position when the core cover 17 is fixedly engaged with the base 8. Thus, the parts and elements of the coil device 1 can easily be assembled to form a desired final product.

The support portion 3 is formed on its central side portions with claw-like portions 6, while the base 8 is formed on its upper surface with interlocking protrusions 12 which can be interlocked to the corresponding claw-like portions 6. The claw-like portions 6 and the interlocking protrusions 12 constitute an interlocking mechanism between the core cover 17 and the base 8. As previously described, the core cover 17 is engaged at its longitudinal opposite ends with the base 8 through the engagement mechanism and interlocked at its central side portions to the base 8 through the interlocking mechanism. Therefore, the core cover 17, when once attached to the base 8, it can hardly be detached from the base 8. Thus, owing to a provision of such an interlocking mechanism, the coil device 1 is further enhanced in vibration resistance and shock resistance.

Furthermore, as shown in FIG. 2, the support portion 3 is provided on its reversed surface with four projections 7, while the base 8 is provided on its outer surface with recesses 13 engageable with the corresponding projections 7. The projections 7 and the recesses 13 constitute, in combination, a further engagement mechanism between the core cover 17 and the base 8. By engaging the projections 7 with the corresponding recesses 13 when the core cover 17 is attached to the base 8, the core cover 17 can be enhanced in accuracy of attachment position. This makes it possible to eliminate chattering (looseness of joints) of the coil device 1.

With respect to the engagement mechanism between the engagement grooves 4 and the ridges 10, the interlocking mechanism between the claw-like portions 6 and the interlocking protrusions 12 and the further engagement mechanism between the projections 7 and the recesses 13, it should be noted that it is good enough only if one of the paired items (namely, grooves 4 or ridges 10, claw-like portions 6 or interlocking protrusions 7, and projections 7 or recesses 13) is formed on the support portion 3 and the remainder is formed on the base 8. In other words, the present invention should not be limited to the arrangement of the above embodiment.

The coil device 1 is assembled in the following manner.

First, as shown in FIG. 1, the two case halves 2 are assembled with the core 15 sandwiched therebetween. By doing so, the core cover 17 with the core 15 received therein is assembled. At that time, the support portion 3 exhibits a flattened rectangular configuration having generally the same size or dimension as the base 8.

Subsequently, the engagement grooves 4 formed in the opposite end portions of the support portion 3 are fitted to the ridges 10 of the base 8 from one side of the base 8 and directly slidingly moved backward toward the opposite side. When one side portion of the base 8 is brought into abutment with the stoppers 11, the claw-like portions of the interlocking mechanism are interlocked with the corresponding interlocking protrusions 12 and the projections 7 of the further engagement mechanism is engaged with the corresponding recesses 13. By doing so, the positioning of the core cover 18 is completed and the core cover 17 is firmly attached to the base 8.

Then, the wiring coil 14 is wound around the coil cover 17 and the terminal portions of the wiring coil 14 are pulled out of the guide grooves 16 so as to be soldered to the corresponding pin terminals 9. By doing so, the procedure for assembling the coil device 1 is completed. It is, of course, accepted that the wiring coil 14 is wound around the coil cover 17 after the completion of the procedure for assembling the coil cover 17 instead of after the attachment of the coil cover 17 to the base 8 as in the above-mentioned example.

According to the feature of a present invention, the coil device comprises a coil body with a wiring coil wound therearound, in which the coil body is composed of a core cover with a core received therein, and a base which is provided with terminals, wherein a support portion is disposed on the core cover and is engaged at its opposite ends to the base through an engagement mechanism composed of an engagement groove and a ridge. Accordingly, the coil device has enhanced vibration resistance and shock resistance. This makes it possible to eliminate the troublesome operation, which would otherwise be required as in the conventional device, for fixing the coil cover directly to the base by adhesive agent or the like in order to avoid assembling chattering or looseness of joints. Since there are such advantages that assembly is easy and simple, no adhesive is required, and expenses for materials can be reduced, the coil device can be manufactured at a lower cost.

According to another feature of the present invention, the engagement mechanism is provided with a stopper. By virtue of provision of the stopper, the core cover, when being attached, can easily and reliably be positioned. Thus, the coil device can more easily be assembled.

According to a further feature of the present invention, the support portion of the core cover and the base are interlocked together through an interlocking mechanism composed of a claw-like portion and an interlocking protrusion. By virtue of the foregoing construction, the core cover, when once attached, is not easily detached from the base. Thus, the coil device is prevented from escaping and there can be obtained a more rigid coil device which is further enhanced in vibration resistance and shock resistance.

Moreover, according to a still further feature of the present invention, the support portion of the coil cover is engaged with the base through further engagement mechanism composed of a projection and a recess. Owing to the foregoing further engagement mechanism composed of a projection and a recess, the core cover is enhanced in accuracy of attachment position. This makes it possible to eliminate attachment chattering of the coil device.

Obviously, numerous modifications and variations of the present invention are possible in light of the above teachings. It is therefore to be understood that within the scope of the appended claims, the invention may be practiced otherwise than as specifically described herein.

What is claimed is:

1. A coil device comprising:

a coil body having a magnetic core, a wiring coil wound around said magnetic core, and an insulative core cover for receiving therein said magnetic core;

an insulative base for mounting thereon said coil body, said insulative base having terminals;

said core cover having a support portion adaptable to said insulative base; and engagement grooves formed in the vicinity of opposite end portions of one of either said support portion or said insulative base, and ridges formed in the vicinity of opposite end portions of the other of either said insulative base or said support portion, said engagement grooves and said ridges being engageable and defining an engagement mechanism by which said support portion and said insulative base may be brought into engagement.

2. A coil device as claimed in claim 1, further comprising a stopper for limiting a relative position between said support portion and said insulative base.

3. A coil device as claimed in claim 2, wherein said stopper is on said insulative base and limits movement of said support portion relative to said insulative base.

4. A coil device as claimed in claim 2, further comprising a claw-like portion on one of either said support portion or said insulative base, and an interlocking protrusion on the other of either said insulative base or said support portion, said interlocking protrusion being engageable with said claw-like portion.

5. A coil device as claimed in claim 1, further comprising a claw-like portion on one of either said support portion or said insulative base, and an interlocking protrusion on the other of either said insulative base or said support portion, said interlocking protrusion being engageable with said claw-like portion.

6. A coil device as claimed in claim 1, further comprising a projection on one of either said support portion or said insulative base, and a recess in the other of either said insulative base or said support portion, said projection being engageable with said recess.

* * * * *